US007900657B2

(12) United States Patent
Babu et al.

(10) Patent No.: US 7,900,657 B2
(45) Date of Patent: Mar. 8, 2011

(54) JAW FOR SEALLESS STRAPPING MACHINE

(75) Inventors: Sailesh Babu, Lake Villa, IL (US); Michael Starozhitsky, Long Grove, IL (US); Paul J. Storiz, Grayslake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 271 days.

(21) Appl. No.: 11/748,669

(22) Filed: May 15, 2007

(65) Prior Publication Data

US 2007/0277898 A1 Dec. 6, 2007

Related U.S. Application Data

(60) Provisional application No. 60/803,408, filed on May 30, 2006.

(51) Int. Cl.
*B21F 9/02* (2006.01)
*B21F 99/00* (2006.01)

(52) U.S. Cl. ..... 140/93.2; 140/150

(58) Field of Classification Search ..... 100/29, 100/30, 33 R; 140/93.2, 93.4, 123.5–123.6, 140/150, 152–153
See application file for complete search history.

(56) References Cited

U.S. PATENT DOCUMENTS 2,549,626 A * 4/1951 Mosey ..... 140/93.2
3,284,049 A * 11/1966 Haraden ..... 254/216
3,327,619 A 6/1967 Sellman
3,815,929 A 6/1974 Steinberger et al.
4,154,158 A * 5/1979 Leslie et al. ..... 100/29
4,487,078 A 12/1984 Schmitz et al.
4,546,657 A 10/1985 Jaeger
4,781,390 A 11/1988 Steinberger et al.
6,079,303 A 6/2000 Lyachovitsky
2009/0072502 A1 3/2009 Weller et al.

FOREIGN PATENT DOCUMENTS

WO 2005118224 A1 12/2005

OTHER PUBLICATIONS

International Search Report and Written Opinion of the International Searching Authority issued in connection with PCT/US2010/038122 on Aug. 11, 2010.

* cited by examiner

*Primary Examiner* — Dana Ross
*Assistant Examiner* — Mohammad Yusuf
(74) *Attorney, Agent, or Firm* — Levenfeld Pearlstein, LLC

(57) ABSTRACT

A jaw for a sealless strapping machine includes a jaw element having a body that defines a linkage portion, a hook portion and a base portion. The hook portion extends transverse to the leg portion. The linkage portion, hook portion and base portion are contiguous and are formed from a single piece of material. The jaw element includes a plurality of punches extending upwardly from the base portion, and define a juncture of the punches and the base. Each punch is defined by a peak and a valley between the peak and the peak of an adjacent punch. The juncture of the punches and the base is formed as a relieved having a smooth radii transitions along the relieved area.

8 Claims, 3 Drawing Sheets

JAW FOR SEALLESS STRAPPING MACHINE

BACKGROUND OF THE INVENTION

The present invention is directed to a jaw for use in a sealless strapping machine for forming a sealless seal. More particularly, the present invention is directed to a one-piece jaw for forming a sealless seal.

Strapping machines are in widespread use. Typically, strapping machines are designed for use with metal (steel) or plastic strapping. In use, strapping is wrapped around the load, tensioned and sealed to itself. In use of metal strapping, the seal can be formed by use of a separate seal that is positioned around the strap and crimped onto the overlapping courses of strap. The seal can also be formed by gripping the strap material sections between a punch and the strapping machine jaw and cutting portions of the over- and under-lying courses of strap material into one another to interlock the strap courses. Such a seal is referred to as a sealless seal.

This action creates a locking action that provides additional strength to the strap, so that the tension in the band is maintained. The geometry of the jaw is highly engineered and does not lend itself to change. The jaws, by the nature of the design, experiences extremely high fluctuating stresses, that can result in fatigue failure if the maximum tensile stresses at the shear section exceeds half the shear yield strength. There are tremendous gains to be had if the stresses stay at or below ½ the yield strength.

Failure of the jaws can occur by fracture at the interface of the punch with the jaw structure. Again, this is due to the high localized stresses that are exhibited at this juncture. In order to address this, it has been thought that a build-up of material (e.g., making the jaw thicker) at the juncture would preclude or lessen the chances of the jaw failing. While this has increased the jaw life, it results in other undesirable characteristics, namely, the jaws have become too large and heavy and the space for the strap to move into the jaw area and for the strap to reside during the sealing operation is too small.

Another approach has been to use a two piece design that relies on improving wear performance through the use of two different materials (one for the bearing surface, e.g., the punches, and one for the bulk). Such as design lowers the shear cross sectional area that is subjected to the highest loads, and hence lowers fatigue life.

Known punches, e.g., bearing surfaces, are such as that shown in U.S. Pat. No. 6,554,030 to Cheung, et al. Each the fixed and movable punches include a plurality of punch heads. The punches are mounted to the jaw by fasteners to permit removing the punches for replacement, repair or maintenance. One drawback to this design is that the bearing surfaces (punches) are mounted to the jaw structure using fasteners, such as bolts. The bores or holes that are formed to secure the punches to the jaw structure also create areas that can be susceptible to failure.

Accordingly, there is a need for a jaw seal arrangement in which the jaw will not fail under load and that provides sufficient space in and around the punches for the positioning of strap in the jaw for sealing.

BRIEF SUMMARY OF THE INVENTION

A jaw for a sealless strapping machine includes a jaw element having a body that defines a linkage portion, a hook portion and a base portion. The hook portion extends transverse to the leg portion.

The linkage portion is contiguous with the hook portion which is contiguous with the base portion. The linkage, hook and base are formed from a single piece of material.

The jaw element includes a plurality of punches, preferably three punches (three peaks with two, intermediate valleys), that extend upwardly from the base portion to defining a juncture. Each punch is defined by a peak and a valley between the peak and the peak of an adjacent punch. The juncture of the punches and the base is formed as a relieved area.

The relived area defines a first transition between the punches and the base and second transition between the base and the support leg. The first and second transitions are formed having smooth radii, defining the relieved area. The transitions are formed parallel to a longitudinal direction of the jaw.

In a present jaw, the relieved area has a depth that is about equal to or greater than a depth of a valley as measured from its respective adjacent peaks to a base of the valley. The jaw can be configure such that the peaks have about equal heights and the valleys have about equal depths.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
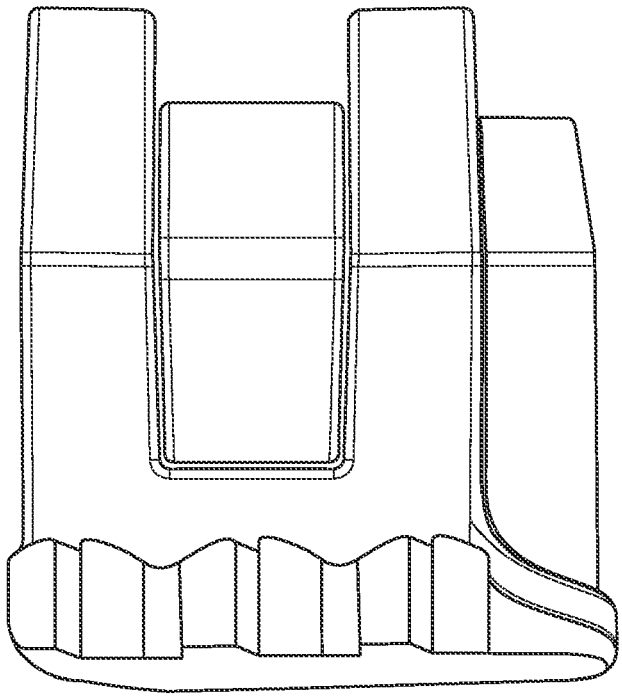
FIG. 1 is a front view of a jaw assembly that has been formed, in part, in accordance with the principles of the present invention, the jaw assembly shown at a slight upward angle.
Figure 2:
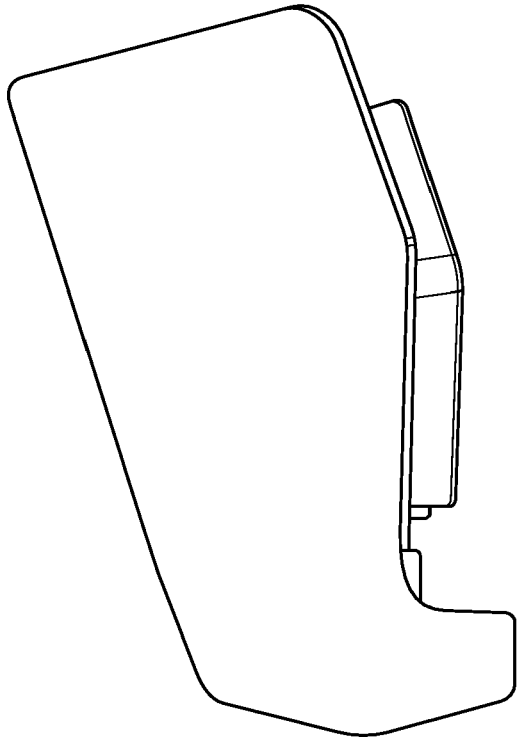
FIG. 2 is a side view of the jaw assembly of FIG. 1.
Figure 4:
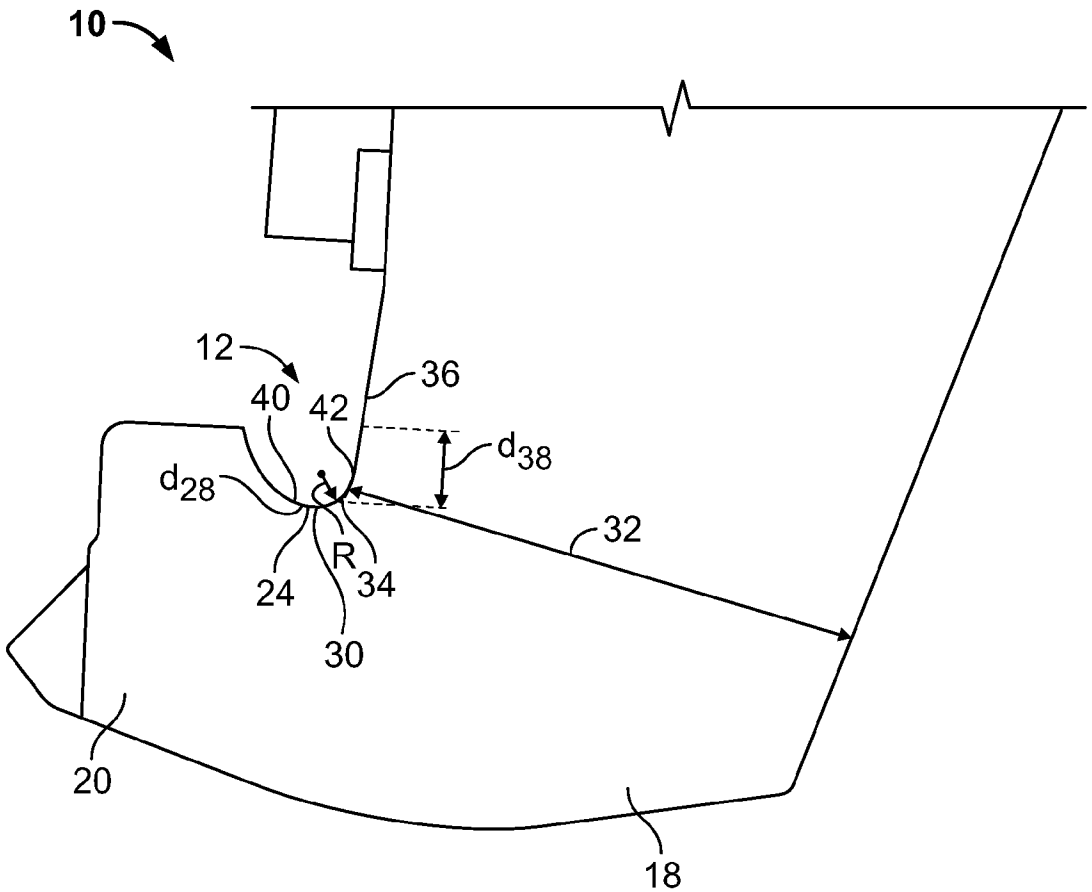
FIG. 4 is a side view of the jaw assembly.
Figure 3:
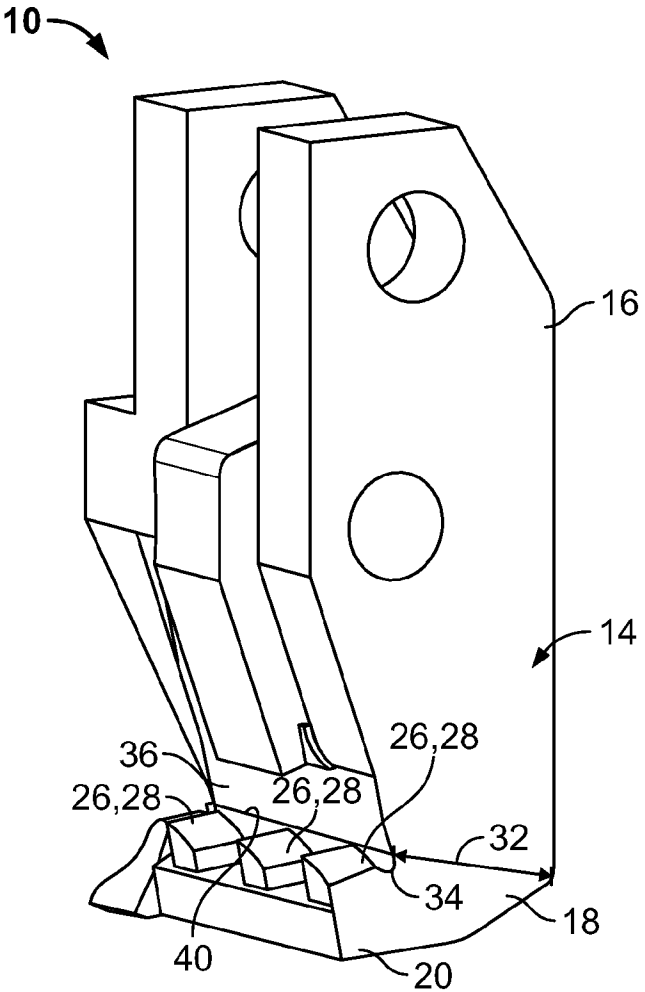
FIG. 3 is a front perspective view of the jaw assembly.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to figures, there is shown a jaw assembly 10 having a relieved region 12 embodying the principles of the present invention. The jaw assembly 10 includes a body 14 having a linkage portion 16 (that portion that is operably connected to the strapping machine—not shown), a hook portion 18 that extends generally transverse to the linkage or leg portion 16 and a base portion 20. The hook 18 extends transverse, toward an opposing hook portion (not shown).

The punches 22, which are those portions of the jaw 10 that contact and punch (deform or cut) the strap, are formed on the base portion 20 and extend upwardly from the base 20. The punches are defined by peaks 26 and valleys 28. The assembly 10 is a contiguous, unitary element. That is, unlike known jaws which use separate, attached punches, the present jaw assembly 10 uses a unitary jaw element with the punches 22 formed as part of the jaw 10. This precludes the need for holes or bores in the jaw structure (for mounting screws or bolts) that otherwise could weaken the jaw.

Figure 6:
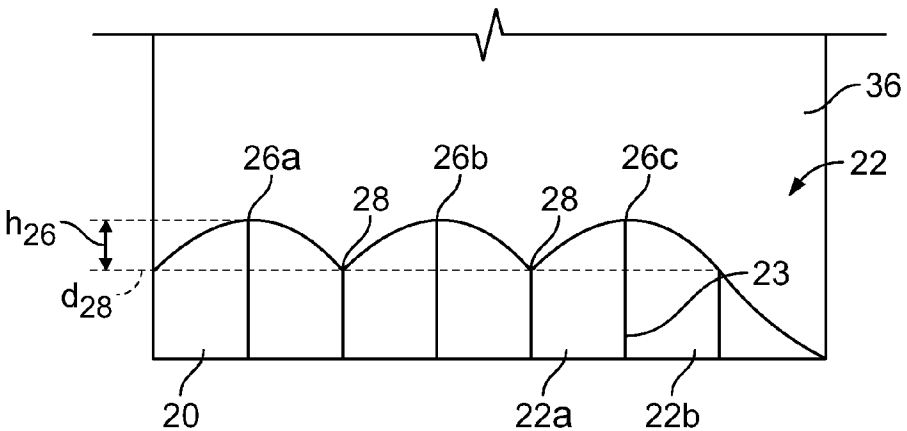
FIG. 6 is a front view showing the relationship of the punches (peaks and valleys) to the base and the jaw.
Figure 5:
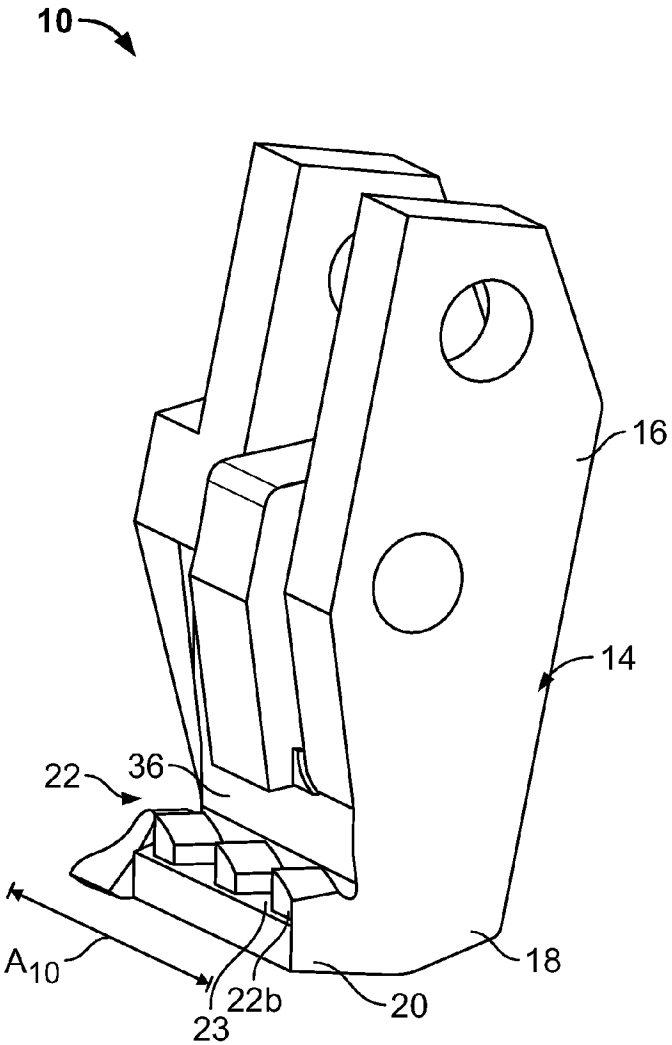
FIG. 5 is another perspective view of the jaw of the present invention, similar to that shown in FIG. 3.

As best seen in FIG. 6A, the juncture (indicated at 24) of the punches 22 and the base 20 is formed in counter-intuitive manner. Rather than a build-up of material at the juncture 24, the material at the juncture 24 is relieved or removed and the transition from the punch 22 to the base 20 and the base 20 to the support leg 16 surfaces are formed having relatively large radii, thus forming the respective relieved areas 40, 42.

As set forth above, the punches 22 are formed as raised areas or peaks 26 (for first contact with the strap), much like teeth, and root areas or valleys 28 between the raised areas 26. The root areas 28 extend transverse to the longitudinal direction of the jaw $A_{10}$ and essentially divide the peaks 26 from one another. In the illustrated embodiment, there are three peaks 26*a,b,c*. The peaks 26*a,b,c* are separated from the hook portion 18 at a transition area 30. The transition area 30 extends parallel to the direction $A_{10}$ of the jaw 10 and transverse to the root areas 28. The faces of the punches (e.g., 22*a* and 22*b*) are angled slightly rearward from the peak 26 to the root 28, to define a projected or crested front face (as indicated at 23).

A present jaw 10 includes a one-piece body made of high strength high fatigue material such as high alloy steel, for example, D2 or DC53 heat treated to hardness in excess of 62 RC. Referring to FIGS. 5 and 6A-C, the jaw 10 includes a maximum possible metallic section (indicated at 32 in FIG. 5), along the shear plane where shear stresses are highest and fatigue related failure occurs. This feature reduces the effective shear stress along the section.

The strapping surface 22 (the punch) dictates the strap strength and is formed by the peak and valley features 26, 28. A smooth radius, indicated at 34 blends in the peak 26 and valley 28 features to the back face 36 with a radius R that seamlessly blends these features of the geometry. In a present jaw 10, a sand blasted or shot blasting process is used to establish a compressive stresses at the surface of the fillet area. This improves fatigue life.

To ensure that static stresses are lowest at the shear section, the depth of the undercut $d_{38}$ preferably closely matches the peak to valley height $h_{26}$. This is established by thinning the section 32. To avoid any stress risers on this surface, the depth of the undercut $d_{38}$ is more than or approximately equal to the peak to valley height. That is, the radius at 34 is formed to a depth $d_{38}$ that is about at the valley 28 depth $d_{28}$ to (relieve stresses and to) prevent failure of the jaw 10, while at the same time, retaining sufficient material to provide strength. The highest stresses are seen at the interface of the peaks 26 and the back face 36. By eliminating the point junctures (of the peaks 26 and face 36), and creating a line interface, (see at 40), the highest stress areas are eliminated.

The present jaw can be used on, for example, an M40 strapping machine currently available from ITW Signode of Glenview, Ill.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the invention.

What is claimed is:

1. A unitary jaw for a sealless strapping machine, comprising:

a jaw element having a body defining a linkage portion, a hook portion, a base portion, and a plurality of punches, the hook portion extending transverse to the linkage portion, the linkage portion being formed integral with and as part of the hook portion and the hook portion being formed integral with and as part of the base portion and wherein the linkage portion, the hook portion, the base portion, and the plurality of punches together are formed from a single piece of material, the plurality of punches formed integral with and extending upwardly from the base portion defining a juncture of the punches and the base, each punch defined by a peak and a valley between the peak and the peak of an adjacent punch, wherein the juncture of the punches and the base is formed as a relieved area, wherein the relieved area defines a first transition between the punches and the base and a second transition between the base and the linkage portion, and wherein the first and second transitions are each formed having a smooth radius, defining the relieved area, the transitions being formed parallel to a longitudinal direction of the jaw, wherein the relieved area has a depth that is greater than a depth of the valley, and wherein the depth of the valley is measured from the valley's respective adjacent peaks to a base of the valley.

2. The jaw in accordance with claim 1 including three punches defined by three peaks and two valley, one between each adjacent peak.

3. The jaw in accordance with claim 2 wherein the peaks have about equal heights.

4. The jaw in accordance with claim 2 wherein the valleys have about equal depths.

5. A unitary jaw for a sealless strapping machine, comprising:

a jaw element having a body defining a linkage portion, a hook portion, a base portion, and a plurality of punches, the hook portion extending transverse to the linkage portion, the linkage portion being formed integral with and as part of the hook portion and the hook portion being formed integral with and as part of the base portion and wherein the linkage portion, the hook portion, the base portion, and the plurality of punches together formed from a single piece of material, the plurality of punches formed integral with and extending upwardly from the base portion defining a juncture of the punches and the base, each punch defined by a peak and a valley between the peak and the peak of an adjacent punch, a transition defined between the punches and the base having a smooth radius and the base and the linkage portion having another smooth radius, the transition being formed having the smooth radii and defining a relieved area, wherein the transition is formed parallel to a longitudinal direction of the jaw and wherein the relieved area has a depth that is greater than a depth of the valley, and wherein the depth of the valley is measured from the valley's respective adjacent peaks to a base of the valley.

6. The jaw in accordance with claim 5 including three punches defined by three peaks and two valley, one between each adjacent peak.

7. The jaw in accordance with claim 6 wherein the peaks have about equal heights.

8. The jaw in accordance with claim 6 wherein the valleys have about equal depths.

* * * * *